United States Patent [19]

Copp

[11] 4,071,178

[45] Jan. 31, 1978

[54] MACHINE FOR USE WITH MOVING WEBS

[76] Inventor: Robert M. Copp, 271 Thames St., Bristol, R.I. 02809

[21] Appl. No.: 693,165

[22] Filed: June 7, 1976 (Under 37 CFR 1.47)

[51] Int. Cl.[2] ..... B65H 23/18

[52] U.S. Cl. ..... 226/39; 226/114; 226/119

[58] Field of Search ..... 226/113, 114, 39, 33, 226/141, 159, 118, 119

[56] References Cited

U.S. PATENT DOCUMENTS

| | | | |
|---|---|---|---|
| 1,941,597 | 1/1934 | Cavagnaro | 226/114 |
| 3,007,368 | 11/1961 | Rosenblum | 226/114 X |
| 3,726,458 | 4/1973 | Rabl | 226/159 X |
| 3,743,567 | 7/1973 | Abler | 226/113 X |
| 3,933,564 | 1/1976 | Jensen | 226/114 X |

*Primary Examiner*—Richard A. Schacher
*Attorney, Agent, or Firm*—Wolf, Greenfield & Sacks

[57] ABSTRACT

A machine for interrupting a portion of an otherwise continuously moving web of material to enable one or more manufacturing operations to be performed on the stopped portion of the web while the remaining portions of the web are advanced continuously. The machine is interposed between a pair of other machines in a production line in which one of the machines continuously feeds the web to the interrupting machine and the other machine continuously draws the web from the interrupting machine. The interrupting machine includes means to take up the web fed continuously to the interrupting machine as well as means for storing and paying out a length of web from the outlet end of the machine. The web is advanced and stopped in precisely controlled incremental lengths to insure proper registration of the stopped portion of the web with the manufacturing instrumentalities mounted on the interrupting machine.

11 Claims, 10 Drawing Figures

Fig. 8
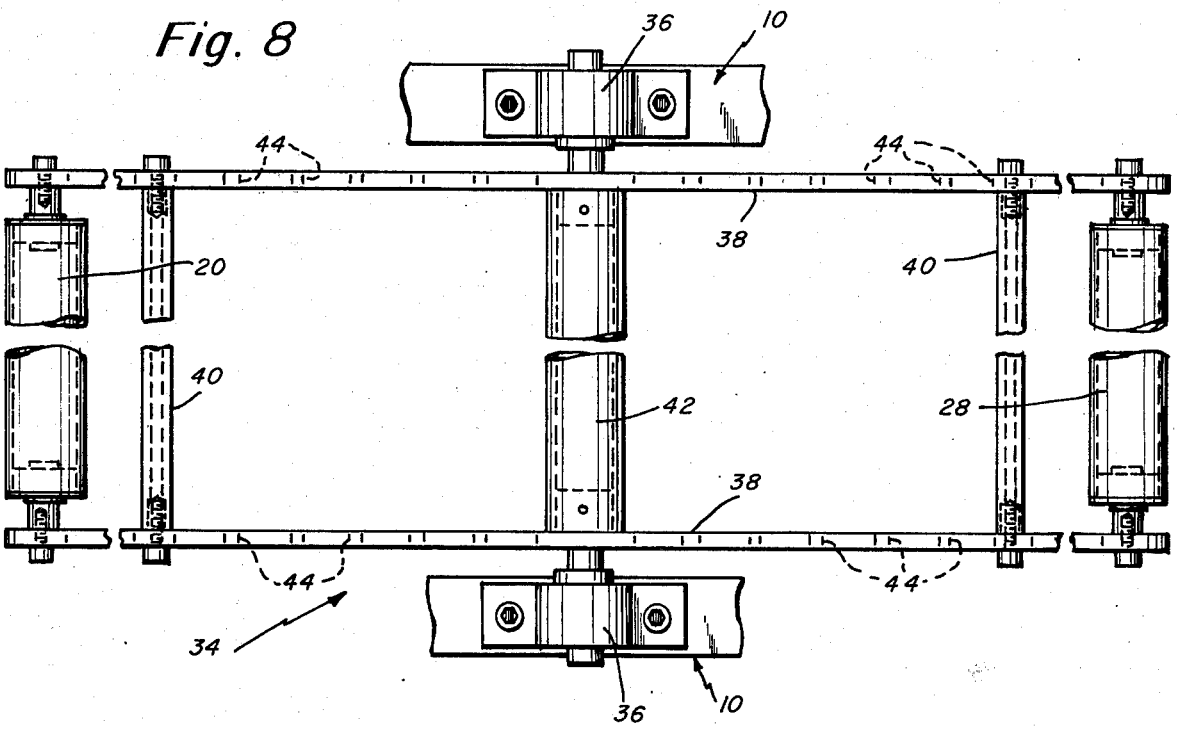
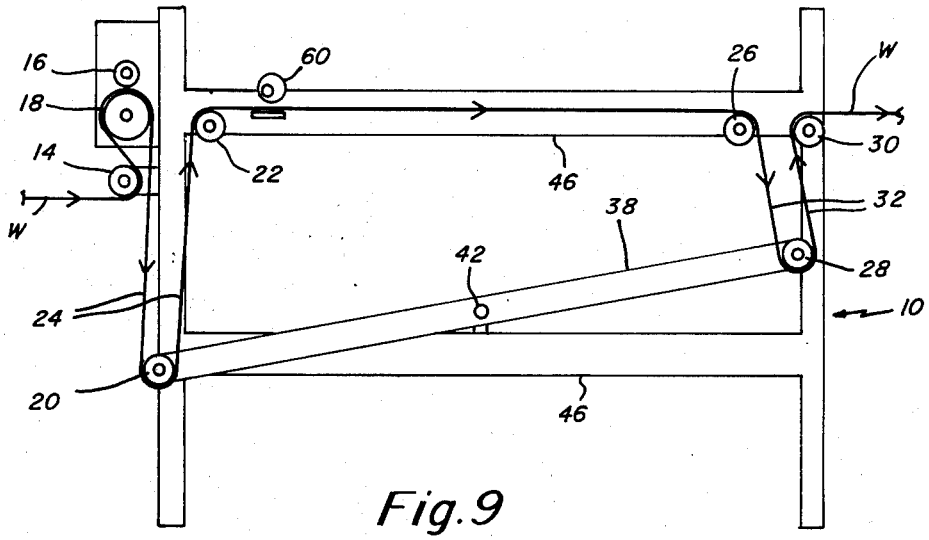
Fig. 9

MACHINE FOR USE WITH MOVING WEBS

BACKGROUND OF THE INVENTION

This invention relates to the manufacture of products, such as plastic bags, from elongate webs of thin, flexible, sheet material, in which the typical production line includes a plurality of sequentially located machines which feed the web continuously and perform a number of sequential manufacturing operations on the web. Not infrequently, manufacturing operations are required in which the web must be stopped, for example, with certain types of hole punches, hand cutters, sealers, stamp-type printers, grommeting devices or novelty attaching devices. When such stopped-web operations are required, it is essential that the web be stopped in a precise and correct position with respect to the manufacturing devices for performing a particular operation so that the operation will take place at the proper location on the web. It also is important for the device to be capable of operation at a speed equal to that at which the other machines in the production line cause the web to be advanced. It is among the general objects of the invention to provide an improved web interrupting machine of the type described.

SUMMARY OF THE INVENTION

The machine includes a frame having a web receiving end and a web delivering end. Rollers, supported by the frame, receive and guide the web from the receiving end, to the operating region where the operating devices are located, to the delivering end and then out of the machine to the next machine in the production line. A brake, to stop the web, is mounted to the frame in advance of the operating region. Operation of the brake is controlled by an optical shaft encoder which, in turn, is driven by one of the rollers at the receiving end of the machine and about which the web is wrapped. The shaft encoder is mounted by a special free-floating device which enables it to shift and move about to insure that it remains in alignment with the roller to which it is attached.

In order to enable the peripheral production machinery to continue to feed the web at a continuous, uninterrupted speed and to permit a segment of the web to be stopped in the interrupting machine, the portions of the web at the receiving and delivering ends of the machine are maintained in a looped configuration. The loop at the receiving end is defined by a loop roller spaced from the other receiving rollers. Similarly, the loop of the web is defined at the delivery end of the machine by a similarly spaced roller. The loop-defining rollers each are movable toward and away from their associated fixed rollers to enable the length of the inlet and outlet loops to be varied. When a web is being drawn through the machine, the outlet loop is at its longest length and the inlet loop at its shortest. When the brake is operated, the inlet and outlet loop rollers are permitted to move freely in a seesaw-like manner in which the outlet loop is drawn smaller as the next machine in the production line continues to draw the web. That draws the outlet loop roller toward its associated fixed rollers which, in turn, causes the inlet loop roller to move away from its associated fixed rollers, thus enlarging the inlet loop so that it can take up the length of web being fed into the machine from the preceding machine in the production line. During this period, the portion of the web between the brake and the outlet loop is stopped and is positioned in registery with the web operating devices which then can perform their respective operations on the web. Unlike prior web interrupting machines, the present invention has no separate, independent web drive means. The web advances through the machine solely under the influence of the other web advancing machines in the production line.

It is among the objects of the invention to provide an improved web interrupting device for stopping a portion of an otherwise continuously advancing web and for performing one or more manufacturing operations on the stopped portion of the web.

Another object of the invention is to provide a web interrupting device of the type described in which the incremental length of the web advanced through the machine can be controlled with a high degree of precision.

A further object of the invention is to provide a web interrupting machine of the type described which is free of any independent drive mechanisms and which does not require any synchronization between its drive mechanism and the drive mechanisms of the other machines in the production line.

Another object of the invention is to provide a web interrupting device of the type described which is of relatively low cost and uncomplicated construction.

A further object of the invention is to provide a web interrupting device which may be operated at higher speeds than with prior such devices.

Another object of the invention is to provide a web interrupting device of the type described which is capable of carrying a substantial number of devices for operating on the stopped portion of the web.

DESCRIPTION OF THE DRAWINGS

The foregoing and other objects and advantages of the invention will be understood more fully from the following further description thereof, with reference to the accompanying drawings wherein:

FIG. 8 is a fragmented plan view of the seesaw device;

FIG. 9 is a diagrammatic illustration of the configuration of the seesaw roller frame pivoted to its position just before the stopped web segment is to be released.

DESCRIPTION OF THE PREFERRED EMBODIMENT

Figure 1:
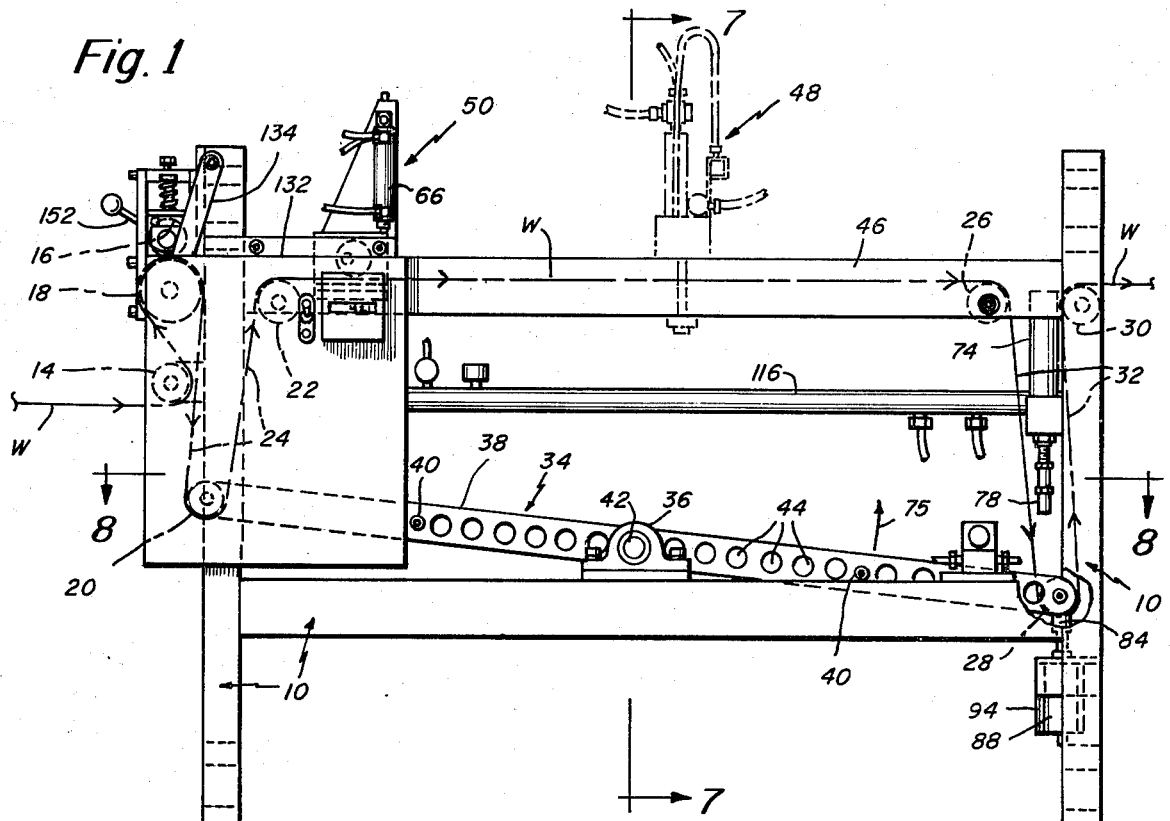
FIG. 1 is a side elevation of the machine.
Figure 2:
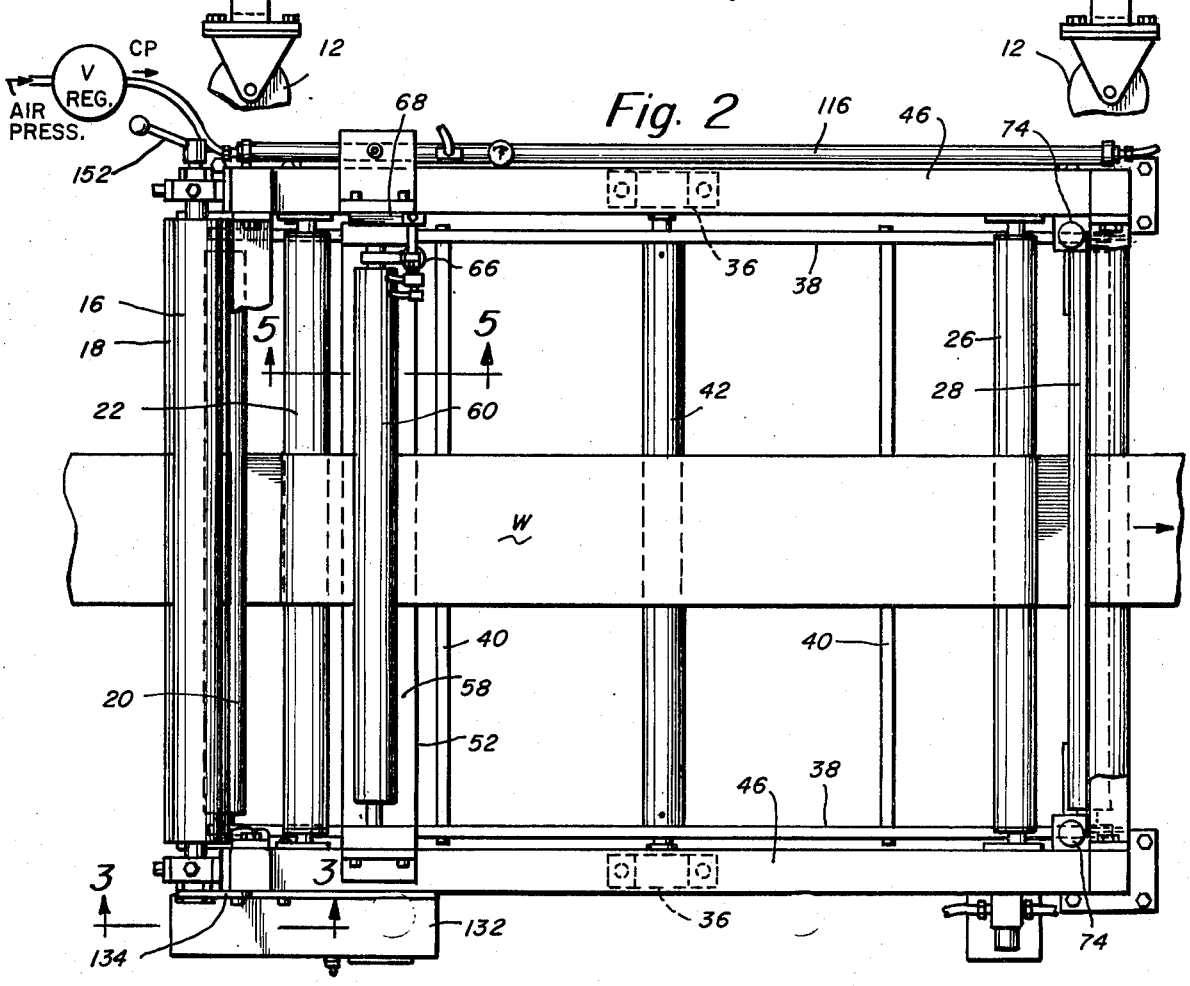
FIG. 2 is a plan view of the machine.

The machine includes a frame indicated generally by the reference character 10 which may be mounted on wheels 12 for mobility to enable the machine to be used at various locations in a factory, should that be desired. In the following description, the direction in which the web advances through the machine will be referred to forwardly (to the right as seen in FIGS. 1 and 2) and, conversely, a direction toward the web receiving end of the machine (to the left in FIGS. 1 and 2) will be referred to as rearwardly. The machine has a web receiving roller 14 about which the web W passes as indicated in FIG. 1. Located above the receiving roller 14 are a pair of nip rollers including an upper nip roller 16 and a lower nip roller 18. The web W passes through the nip rollers 16, 18 and then downwardly about a loop roller 20 and then back upwardly about a level roller 22. The lower nip roll 18 and level roller 22 are rotatably mounted at fixed locations to the the frame 10 and cooperate with the loop roller 20 to guide the web in a loop indicated at 24. As will be described in more detail, the loop roller 20 is movable heightwise toward and away from the rollers 18, 22 to vary the length of web which defines the loop 24.

The web W passes from the level roller 22 to another level roller 26 which is also rotatably mounted to the other end of the frame at the same level as roller 22. From roller 26, the web passes downwardly and about a rearward loop roller 28 and then upwardly and about a web delivering roller 30 from which the web passes to the next machine in the production line sequence. The rollers 26 and 30 are mounted to the machine at fixed locations and loop roller 28 is movable heightwise toward and away from the rollers 26, 30 to vary the length of the outlet loop, indicated at 32.

The loop rollers 20, 28 are mounted to the opposite ends of a seesaw frame 34 which, in turn, is pivotally mounted at its midportion to the frame 10 by bearings 36. Frame 34 includes side members 38, transverse bracing members 40 which are connected at their ends to the side members 38 and a central pivot shaft 42. The side members 38 preferably have a plurality of holes 44 formed therethrough to maintain as low an inertia as is practically possible. As will be described in more detail below, when the device is in a running configuration, the seesaw frame 34 will be inclined rearwardly with the roller 20 in its most raised position and loop 24 being its smallest and with roller 28 in its lowest position with loop 32 being its largest.

The upper portion of the frame includes a pair of longitudinally extending rails 46 which extend along the length of the machine and embrace the horizontal path of the web W between the rollers 22, 26. The various web operating instrumentalities, such as a gang punch suggested in phantom at 48 in FIG. 1, are mounted to the rails 46 and extend across and over the web in readiness to perform their respective functions on the stopped segment of the web. The length of the rails 46 and the horizontal web path extend over the major proportion of the length of the machine and enable a number of different types of bag manufacturing devices to be mounted to the rails, all of which may be operated at the same time.

Figure 5:
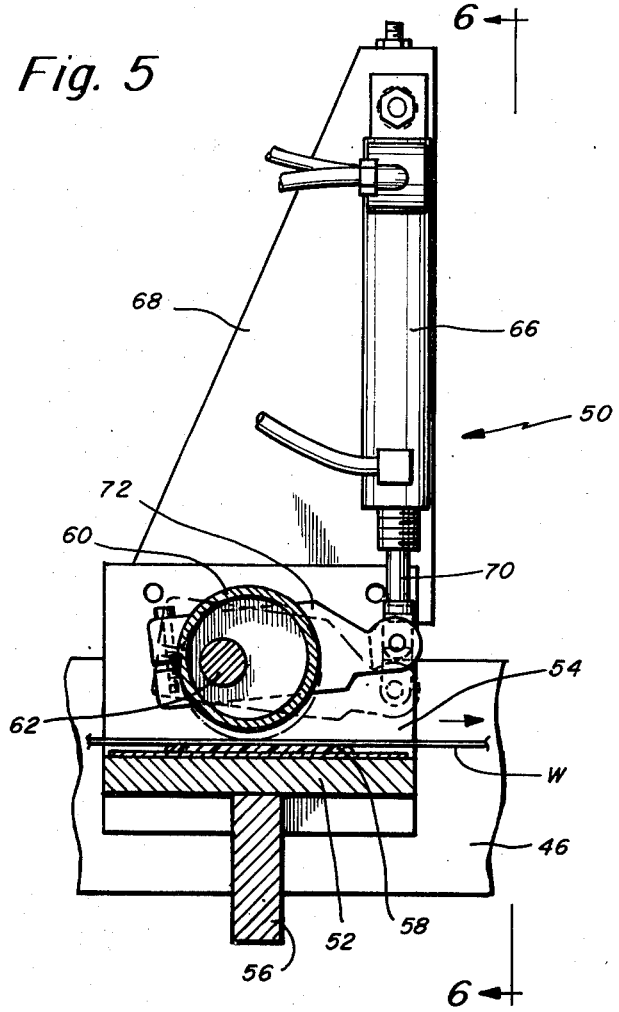
FIG. 5 is a partly sectional elevation of the brake mechanism as seen along the line 5—5 of FIG. 2.
Figure 6:
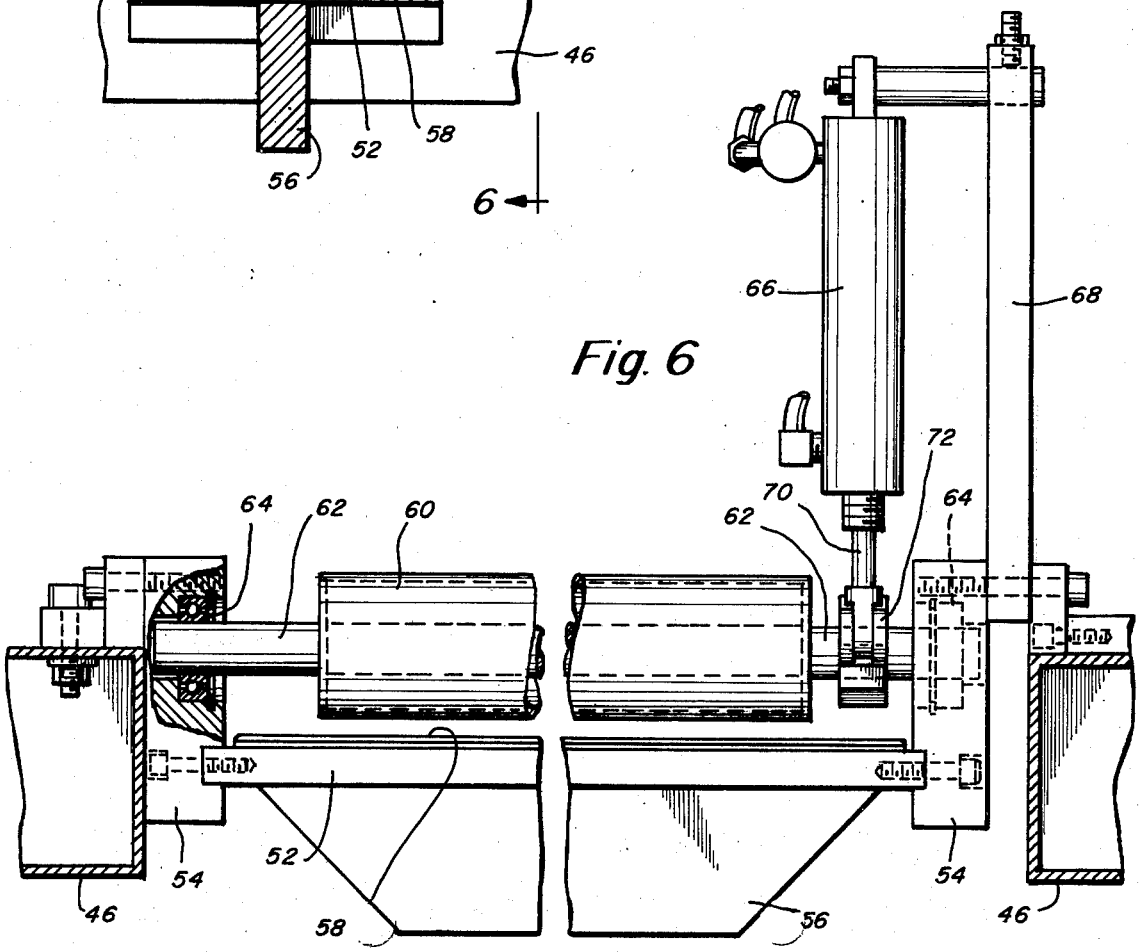
FIG. 6 is an elevation of the brake mechanism as seen along the line 6—6 of FIG. 5.
Figure 7:
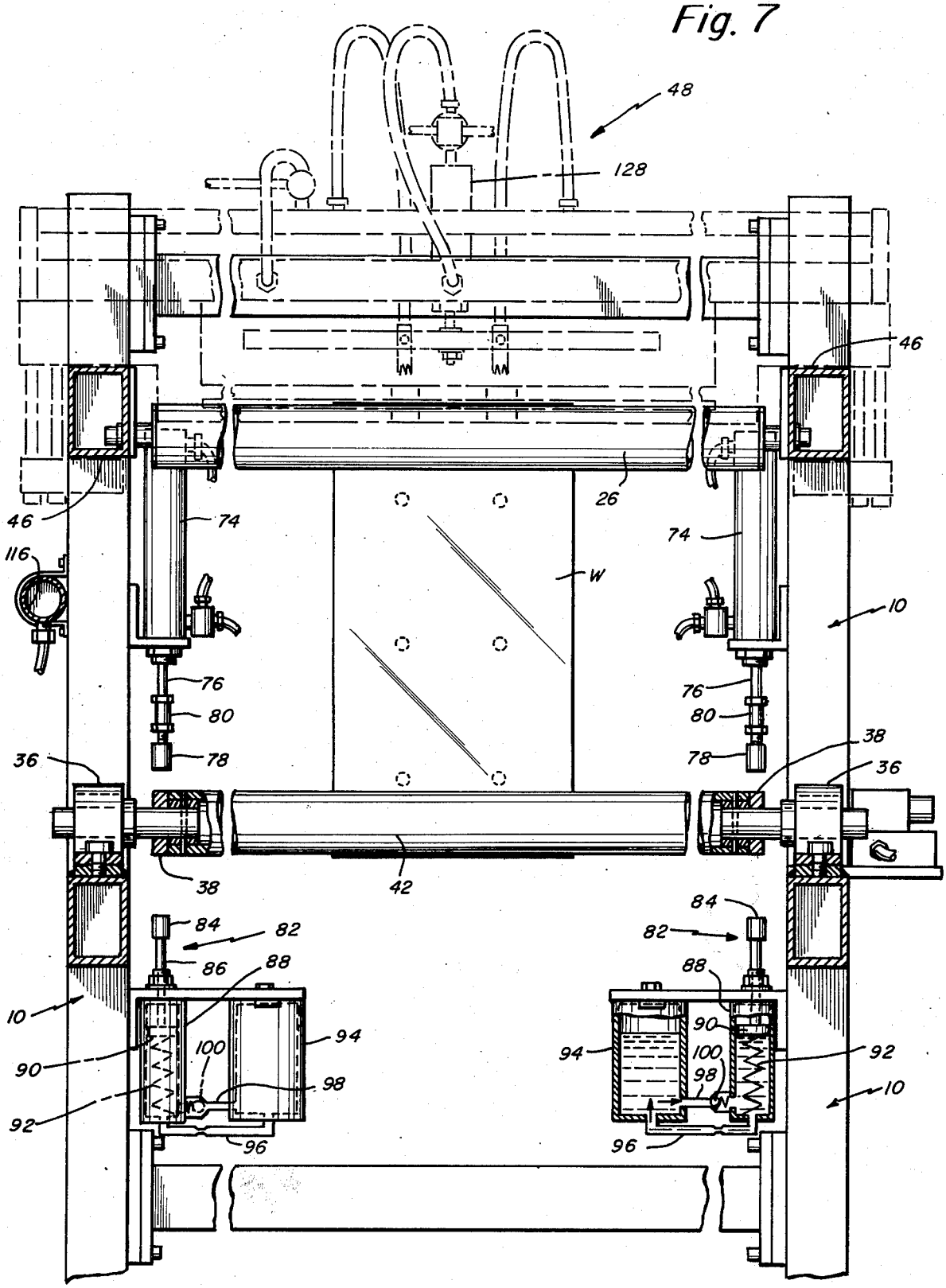
FIG. 7 is a sectional elevation of the machine as seen along the line 7—7 of FIG. 1.

In order to stop a segment of the web, the machine includes a brake mechanism, indicated generally by the reference character 50, which is mounted to the rails in proximity to and just forwardly beyond the level roller 22. The brake mechanism 50 is operated in response to the advancement of a measured length of web W advanced through the machine. The brake mechanism is shown in more detail in FIGS. 5 and 6 and includes a transversely extending brake plate 52 secured at its ends to the rails 46 by mounting brackets 54. A vertically extending stiffening plate 56 may be secured to the brake plate 50 to stiffen it. The upper surface of the plate 52 is covered with a brake pad 58 having a high coefficient of friction and may be made from rubber, polyethylene, or other suitable material which will be effective to grip firmly the web W when the web is pressed downwardly against the pad 58. The plate 52 and braking pad 58 are disposed just beneath the horizontal path of travel of the web W. The web W is clamped to the brake pad 52 by a braking cylinder 60 which is eccentrically secured to a brake shaft 62. The brake shaft 62 is rotatably supported at its ends to the mounting brakets 54 by bearings 64. The shaft 62, braking cylinder 60 and brake pad 58 are arranged so that when the shaft 62 is rotated (in a clockwise direction as seen in FIG. 5), the braking cylinder 60 will swing downwardly to engage the web and press the web into firm engagement with the braking pad 58.

The braking cylinder 60 is operated by an air cylinder 66 which is mounted at one end to one of the rails 46 by a bracket 68. The downwardly extending piston rod 70 of the cylinder 66 is pivotally connected to the end of an arm 72 which, in turn, is securely clamped to the brake shaft 62. When the web W is being advanced to its next incremental position, the air cylinder 66 is in its retracted configuration to maintain the braking cylinder 60 in its upwardly disposed configuration shown in solid in FIG. 5. When it is desired to stop the web W, the air cylinder 66 is actuated to swing the braking cylinder 60 downwardly to its web-engaging position shown in phantom in FIG. 5 which presses the full width of the web W against the brake pad 58 and stops further advancement of that portion of the web immediately.

When the brake is in its released position and the web W is being drawn through the machine, the looping frame 34 is inclined forwardly to maintain the roller 20 in its upper position and to maintain roller 28 in its lower position as shown in FIG. 1. When in this attitude, the loop 24 is at its smallest and loop 32 is at its largest. The frame 34 is maintained in this attitude by a pair of air cylinders 74 mounted on the frame 10 near the outlet end of the machine. The air cylinders 74 have downwardly extending piston rods 76, fitted with rubber bumpers 78 at their ends. The air cylinders 74 are positioned so that their bumpers 78 will engage the ends of the side members 38 of the frame 34 when the air cylinders 74 are actuated. The bumpers 78 are attached to the ends of the piston rods 76 by a threaded connector 80 to enable the effective length of the piston rods 76 to be adjusted. The lower position of the delivery end of the frame 34 is determined by a pair of stops located beneath the frame 34 and in alignment with the side members 38 of the frame 34. The stops 82 include a rubber bumper 84 mounted to the upper end of a piston rod 86 of a shock absorbing device 88. The shock absorbing device 88 includes a cylinder which receives the inner end of the piston rod and a piston 90 slidable in the cylinder 88. The piston 90 is biased upwardly by a compression spring 92. The shock absorbing arrangement also includes a fluid reservoir 94 which is connected to the cylinder 88 through a restricted conduit 96 and also through another conduit 98 which has a check valve 100 permitting flow only from the reservoir to the cylinder 88. When the cylinders 74 are operated to extend the piston rods 76 and urge the frame 34 to the web-advancing position (FIG. 1), the rubber bumpers 78 drive the side rails 38 of the frame 34 downwardly into engagement with the lower bumpers 84 of the shock absorbing device. The restricted flow opening in conduit 96 insures a steady absorption of the shock resulting from the impact of the bumpers 78 against the frame 34. The frame 34 advances to its lowermost position which is determined by the extent to which the rubber bumpers 78 are extended from the cylinders 74.

After the web W has been advanced to the desired extent the brake mechanism 50 is actuated to clamp the web and, at the same time, the piston rods 76 of cylinders 74 are raised to release the frame 34 and permit it to pivot freely under the influence of the moving portions of the web.

The next succeeding machine in the production line continuously draws the web W from the interrupting machine at all times while the next preceding machine in the production line continuously feeds the web to the interrupting machine at the same rate. When the brake mechanism 50 is operated and the seesaw frame 34 is released, the continuous drawing of the web W from the interrupting machine shortens the length of the loop 32 which raises the roller 28 and pivots the frame 34 counterclockwise, as suggested by arrow 75 in FIG. 1, toward the position diagrammatically suggested in FIG. 9. This lowers the roller 20 to take up the slack in the web which results from the continuous feeding into the inlet end of the machine. As the loops 24, 32 are respectively lengthened and shortened, the portion of the web W between the rollers 22, 26 is stopped and the web operating instrumentalities, such as the punch mechanism 48, are actuated to perform their operation on the then stationary portion of the web. The timing of the various elements of the machine is such that the web operating instrumentalities will have completed their operations before the frame 34 has rotated to its full counterclockwise position. The brake then is released and cylinders 74 are simultaneously actuated to enable the web to again be drawn through the machine to its next indexed position and to return the frame 34 to its starting position in which the loop 32 is at its maximum and loop 24 is at its minimum size.

Figure 10:
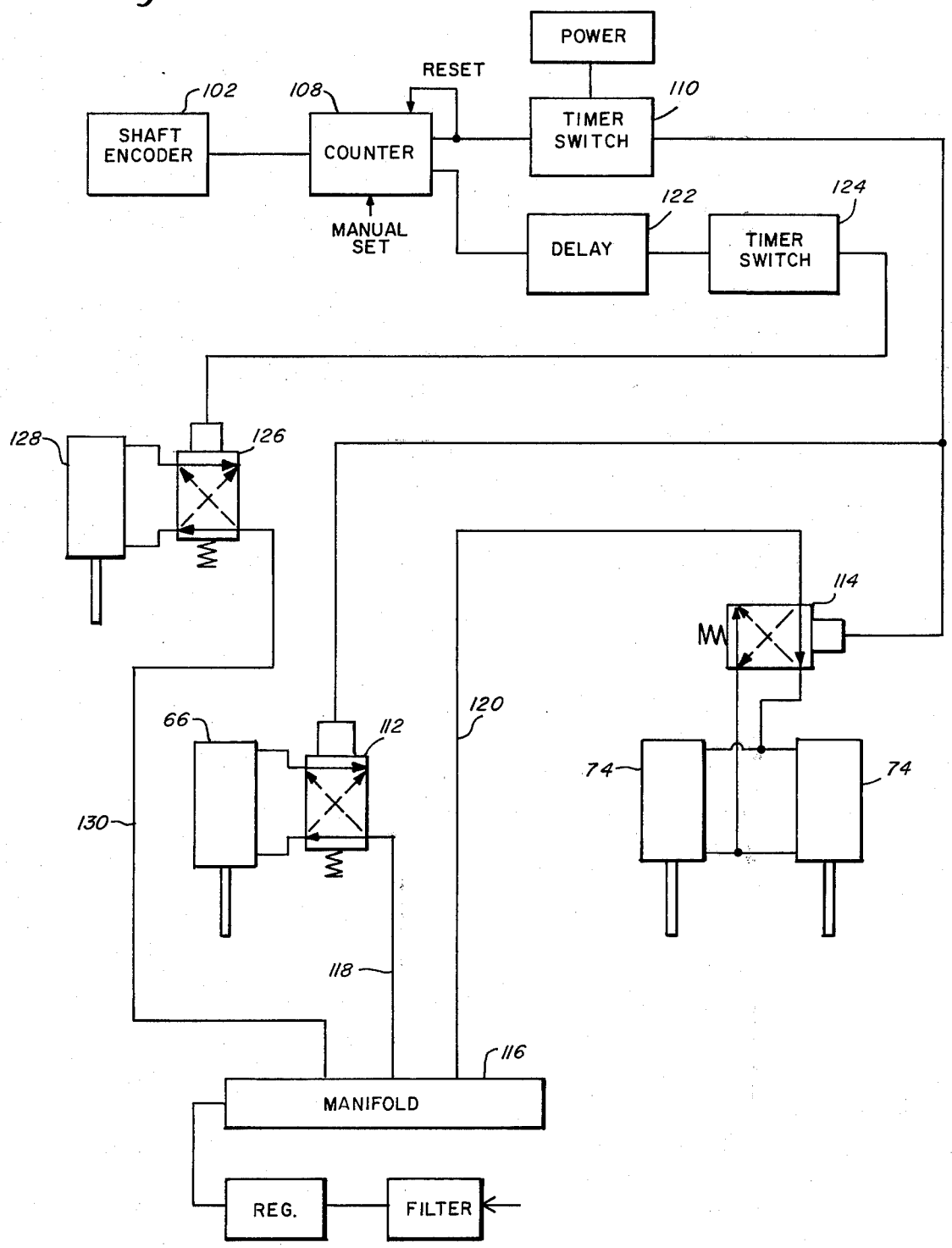
FIG. 10 is a schematic diagram of the control system for the machine.

Operation of the brake mechanism 50 and the cylinders 74 is controlled by an optical shaft encoder indicated generally at 102 (FIGS. 3 and 4) which is driven by a shaft extension 104 of the shaft 106 of the lower nip roller 16. FIG. 10 shows the electrical and pneumatic control circuitry of the machine. The output from the shaft encoder 102 drives a counter 108 which may be manually preset to provide an output pulse in response to a predetermined number of output pulses from the shaft encoder (and, therefore, a predetermined angular rotation of the lower nip roll 16). The counter 108 is of the self-setting type and resets to zero in response to an output pulse from the counter. The output pulse from the counter 108 triggers a relay or other suitable timing switch 110 which, in turn, simultaneously actuates solenoid valves 112, 114 which control, respectively, the brake cylinder 66 and return cylinders 74. When the web W is being advanced through the machine, the brake cylinder 66 is in its normally retracted configuration because valve 112 is biased in the configuration shown in solid in FIG. 10 in which air under pressure from a manifold 116 is applied to the rod end of air cylinder 66 through line 118. When solenoid valve 112 is actuated, line 118 is switched into communication with the head end of the cylinder 66 to extend the piston rod and operate the brake. Solenoid valve 114 which controls operation of the return cylinders 74 is actuated by the timer switch 110 at the same time as solenoid valve 112. When the web W is being drawn through the machine, valve 114 is spring biased in a configuration in which air under pressure is applied to the head end of each of the cylinders 74 through line 120. When actuated, valve 114 switches to the configuration shown in phantom in FIG. 10 in which the air under pressure is applied from the manifold 116 through line 120 in valve 114 to the rod end of each of the cylinders 74 to retract the piston rods and permit the frame 34 to pivot as described above. Valves 112, 114 remain actuated for a predetermined time interval, controlled by timer switch 110, and then are deactuated to return to their normally biased configurations which will cause the brake to release and the return cylinders 74 to urge the frame 34 to its starting position.

The output from the counter 108 also is employed to initiate operation of the manufacturing device which is to perform an operation on the stopped portion of the web, for example, as the punch device illustrated. In order to insure that the portion of the web to be operated on has stopped when the punch is operated, a delay device, such as a relay 122 is interposed between the counter 108 and a timer switch 124 which controls the operation of a solenoid valve 126 associated with the punch air cylinder 128.

Solenoid valve 126 is biased in a configuration in which from the manifold 116 is applied to the rod end of air cylinder 128 through line 130. When timer switch 124 actuates solenoid valve 126, line 130 is connected to the head end of the air cylinder 128 to drive the punch mechanism down in a punching stroke. The time constant of timer switch 124 is relatively short and deactuates solenoid valve 126 almost immediately after the punching stroke has been completed to retract the piston rod of air cylinder 128 and return the punch mechanism to its starting position. The control circuitry should be arranged and set so that the punch is fully disengaged with the web before the brake is released and the return cylinders 74 return to their normal positions. The various electrical elements and controls of the control circuitry described above may be housed conveniently in a control box 132 mounted to the frame. The manifold 116 should be of a relatively large volume sufficient to store enough compressed air to operate all of the various cylinders without any significant pressure drop which might adversely effect their operation. The manifold 116 may be in the form of an elongate closed tubular member (FIGS. 1 and 2) extending longitudinally along one side of the frame and may be provided with a number of fittings 117 at spaced lotions along the length of the manifold 116. By locating the manifold in this manner, the air supply lines to the various air cylinders to the machine itself as well as the web operating accessories mounted to the machine may be maintained as short as possible thus minimizing pressure drops and delays in the actuation of the various air cylinders.

The use of the optical shaft encoding device to control the starting and stopping of the portion of the web enables the machine to be operated at high speeds while enabling the web to be stopped at regular increments with a high degree of precision. It is important to maintain the shaft encoding device 102 in axial alignment with the axis of the shaft 106 of nip roller 18 under all conditions of operation and, to that end, the optical shaft encoder 102 is mounted in a manner which enables it to shift about with the shaft 106 to conform to any shaft irregularities. To this end, the shaft encoder 102 is securely mounted to the end of a resilient, elongate, spring-like member 134 which is secured at one end to the frame 10. The shaft encoder unit 102 is attached to the other, freely extending end of the spring mounting member 134. The shaft encoder unit 102 thus is permitted freedom of movement in all directions with the elongate spring support 134 except that it is not free to rotate about the axis of the shaft extension 104. This insures that even minor misalignments of the shaft 106 will have no effect on the operation of the optical shaft encoder and will insure a high degree of precision in measuring the angular rotation of the shaft. The shaft encoder unit preferably is disposed interiorly of the electrical control box 132. To this end, a hole is formed in the rear face of the control box 132 and the shaft encoder device 102 is permitted to protrude into the housing 132. It does not rest against or contact the housing in order to permit it the freedom of movement described above.

The upper and lower nip rollers 16, 18 are constructed so that there will be no slippage of the web W through the rollers 16, 18. The lower nip roller 18 which serves as a measuring roller has a smooth outer cylindrical surface about which the web is partially wrapped as shown. The upper nip roller 16 is covered with a sleeve 135 having good frictional characteristics such as rubber and is urged downwardly against the lower nip roller 18 to insure that there will be no slipping between the rollers 16, 18. The length of the rollers 16, 18 is selected so that they will be longer than the widest web with which the machine is to be used so that the more outwardly disposed portions of the slightly resilient sleeve will engage the more outwardly disposed portions of the measuring nip roller 18. Engagement of the web with each of the rollers 16, 18 and simultaneous engagement of the outer ends of the rollers 16, 18 insures that there will be no slipping between the web and the measuring nip roller 18. As a result, the extent of angular rotation of the measuring nip roller 18 can be employed, in combination with the optical shaft encoder, to measure and thereby control the length of web fed before operating the brake and other machine elements. While it is desirable for the upper nip roller 16 to have a slightly resilient outer surface, such as the sleeve 135, it is important that the lower measuring nip roller 18 is relatively non-resilient so that a particular amount of angular rotation of the roller 18 will correspond to a particular amount of linear web travel. By way of example, the measuring nip roller may have a circumference of 10 inches and the optical shaft encoder may be selected to generate 100 pulses for each complete revolution of the roller 18 thus providing an ability to control incremental measurements as fine as 1/10th of an inch. By enlarging the size of the lower roller 18 and/or selecting an optical shaft encoder which will develop more than 100 pulses for each shaft revolution, still higher degrees of precision may be obtained.

Figure 3:
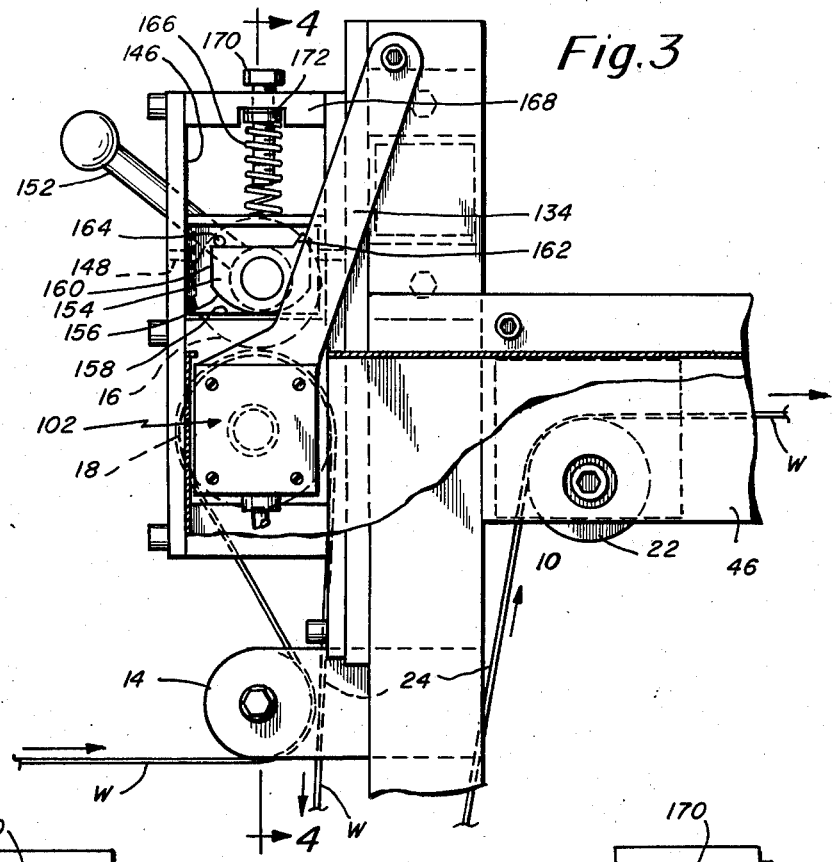
FIG. 3 is an enlarged side elevation of the roller arrangement and shaft encoding device at the web receiving end of the machine.
Figure 4:
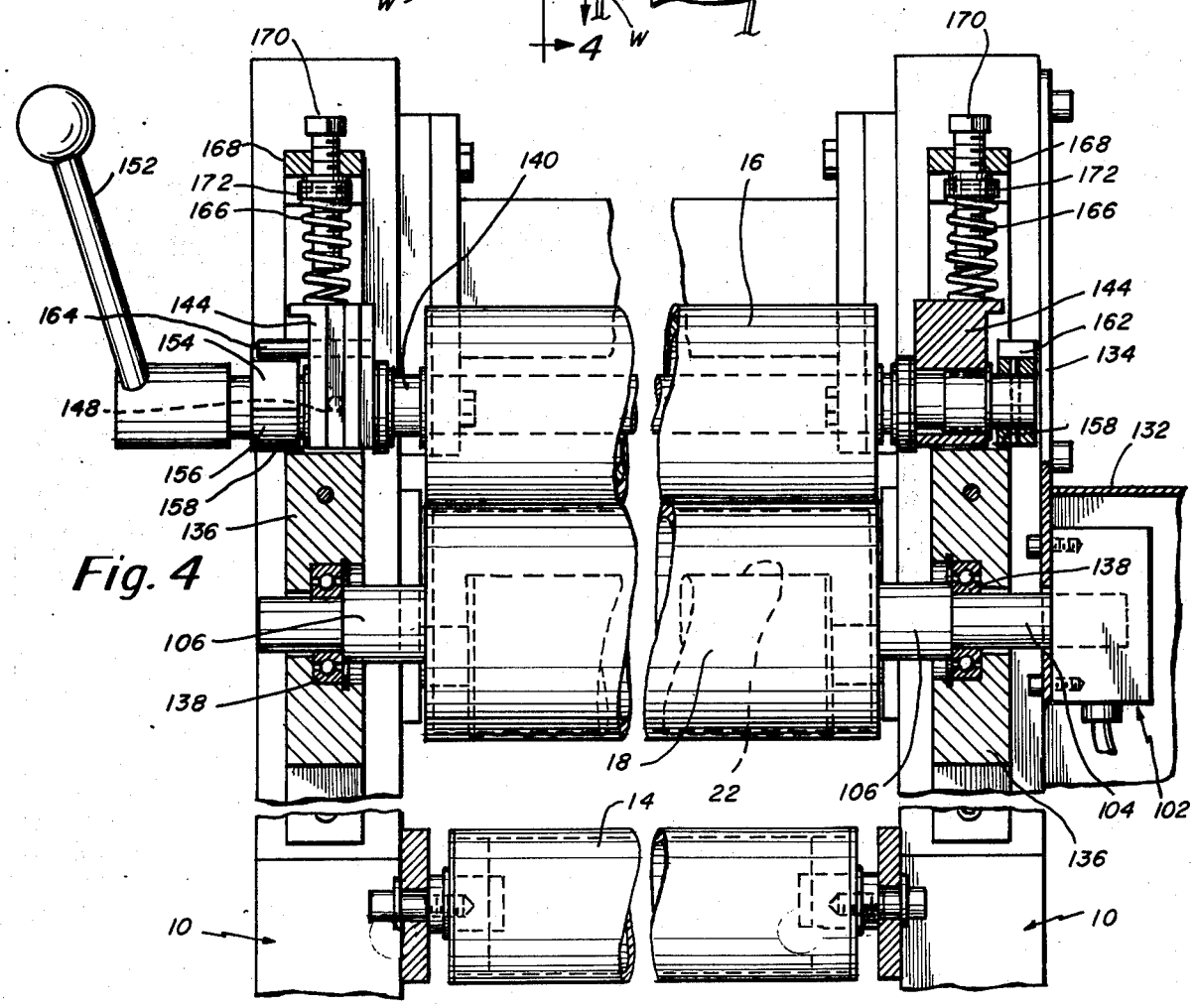
FIG. 4 is a sectional illustration as seen along the line 4—4 of FIG. 3.

The upper and lower nip rollers 16, 18 preferably are arranged so that they can be separated in order to permit the web W to be initially introduced and preliminarily aligned in the machine. In the illustrative embodiment of the invention, this is achieved by mounting the upper nip roller 16 so that it can be raised and spaced from the lower nip roller 18. As shown in FIGS. 3 and 4, the frame 10 includes a pair of nip roll mounting brackets 136. The lower nip roller 18 which is preferably of larger diameter is rotatably mounted to the brackets 136 by bearings 138 which receive the shaft 106 of the lower nip roll 18. The upper nip roller 16 has a shaft 140 which is received in bearings 142 which are carried in vertically movable slides 144. The slides 144 are contained in vertically extending openings 146 formed in each of the nip roll mounting brackets 136. Each of the slides 144 is guided in its vertical movement by a pin 148 which is attached to its slide 144 and which is received in a vertically extending slot 150 formed in its associated bracket 136. The upper nip roll 16 is raised by rotating a handle 152 which is attached to cams 154, each having a cam surface 156 which rests on a shelf 158 on the mounting bracket 136 which defines the lower end of the opening 146. The cams 154 are rotatably mounted to the slides 144 and to the shaft 140 and when the handle is rotated counterclockwise, as seen in FIG. 3, that raises the shaft 140 together with the upper nip roll 16 and slides 144. Each of the cams 154 also is formed with a flat 160 which will rest on the shelf 158 to support the upper nip roll assembly in its raised position. Each of the cams 154 also may have a detent 162 projection which can engage a laterally extending pin 164 on the slide 144 to provide a definite indication when the cam has been rotated to its fully up position and to prevent further rotation of the cam. The pins 164 also may abut the opposite portion of the cam when the nip roller is in its fully lowered position as suggested in FIG. 3. The slides 144 are biased downwardly to maintain them in their lowest position in which the upper nip roller 16 is firmly engaged with the lower nip roller 18. For this purpose, a compression spring 166 extends between the top of each of the slides 144 and the underside of the top portion 168 of the bracket 136. A bolt 170 preferably is threaded downwardly through the upper portion 168 of the bracket 136 to keep the compression spring 166 in place. The force of the spring 166 may be adjusted if desired by a nut 172 which is threaded about the bolt 170 between the upper end of the spring 166 and beneath the upper member 168 of bracket 126.

Summarizing the operation of the machine, in its running position shown in FIG. 1 in which all portions of the web are advancing through the machine, the loop roller frame 34 is in its forwardly inclined attitude shown in FIG. 1. When the predetermined length of web has passed through the nip rollers 16, 18 the counter 108 generates an output pulse which, as described, operates the brake mechanism 50 to grip the web and retract the piston rods of the return cylinders 74. Web operating devices, such as the punch mechanism 48, also are actuated but through suitable delay devices to insure that the web segment between the rollers 22, 26 has stopped. While the web segment is stopped, the succeeding machine in the line continues to draw the web from the delivering end of the machine which shortens the loop 32 thus raising the loop roller 28. This causes rotation of the loop roller frame 34 toward the rearwardly inclined position suggested in FIG. 9 which lowers loop roller 20 to enable loop 24 to be enlarged, thus taking up the web material which is being fed into the machine continuously from the preceding machine in the line. The loop rollers 20, 28 preferably are mounted to the loop roller frame 34 at equal distances from the frame pivot shaft 42 so that the linear distance by which one of the loops is shortened will equal the length by which the other loop is lengthed. The various elements of the machine and the web operating instrumentalities, such as the punch mechanism 48, are arranged and timed so that the web operating devices will have completed their cycle before the loop roller frame 34 has pivoted to its most rearwardly inclined attitude (FIG. 9). The brake mechanism 50 releases the web at this time and the return cylinders 74 are actuated to extend their piston rods and pivot the loop roller frame 34 back to its original position shown in FIG. 1 in which the loop 32 is at its largest and loop 24 is at its smallest size. Return of the rollers 20, 28 to their original running positions causes an acceleration of the loop 32 and, therefore, the trailing portions of the web until the loops 24, 32 have been restored to their starting configurations. Loop 24 is shortened in this operation as loop roller 20 is raised.

When the loop roller frame 34 has been returned to its starting position, the machine then awaits the next output signal from the counter 108 to begin the next cycle. It should be noted that when the machine has stopped a segment of the web, the web still is being fed continuously into the machine and the nip rollers 16, 18 rotate continuously, with the loop 24 enlarging during this interval. The optical shaft encoder thus generates a continuous uninterupted series of signals which are counted by the counter 108. The system of continuously operating nip roller 18, optical shaft encoder and counter 108 thus begin the measuring of the next succeeding web segment without interruption or delay, even though other portions of the web are being stopped. The succeeding measured length of web is taken up in the loop 24 until the brake 50 is released and the cylinders 74 are actuated to return the loop 24 to its starting configuration. This mode of measuring the web length minimizes delay between operating cycles and enables the machine to operate at a high rate which will not require a slowdown in the production line.

It should be understood that the foregoing description of the invention is intended merely to be illustrative thereof and that other modifications and embodiments may be apparent to those skilled in the art without departing from its spirit.

Having thus described the invention, what I desire to claim and secure by Letters Patent is:

1. An apparatus for temporarily interrupting the movement of a portion of an otherwise continually advancing web of material comprising:

a main frame having a web receiving end and a web delivery end;

a first stationary group of rollers mounted to the web receiving end of the frame;

a second stationary group of rollers mounted to the web delivery end of the frame;

a seesaw loop frame pivotally mounted intermediate its ends to the main frame for free pivotal movement on the main frame, the loop frame having loop rollers rotatably supported at each of the opposite ends of the loop frame, the loop frame and loop rollers being disposed so that when the loop frame is pivoted, one of the loop rollers will move toward its associated group of stationary rollers and the other of the loop rollers will move away from its associated group of stationary rollers; the loop rollers being constructed and arranged to cooperate with their associated group of stationary rollers to form looped paths for the web;

retaining means for maintaining the loop frame in an initial, web-advancing position, in which the loop roller associated with the first group of stationary rollers is in proximity to said first group of stationary rollers and in which the other loop roller is located distally with respect to the second group of stationary rollers, thereby to define a relatively short loop at the receiving end of the frame and a relatively large loop at the delivery end of the frame;

said retaining means being constructed to release the looping frame and to permit the looping frame to pivot freely and solely in response to movement of the web; and brake means mounted to the main frame for engagement with the web at a location in proximity to the web receiving end of the main frame and between the portion of the path of the web which is between the loop rollers for stopping a segment of the web which is disposed between the loop rollers.

2. An apparatus as defined in claim 1 further comprising:

at least one of the rollers in the first group thereof having means for maintaining the web in firm, non-slipping engagement therewith; and means responsive to a predetermined angular rotation of said roller for operating the brake means.

3. An apparatus as defined in claim 1 further comprising:

means for operating the loop frame retaining means and for releasing the loop frame simultaneously with operation of the brake means.

4. An apparatus as defined in claim 3 further comprising:

control means, operative at a predetermined time after operation of the brake means for deactivating the brake means to release the web and for returning the movable rollers to their initial position.

5. An apparatus as defined in claim 1 further comprising:

stop means mounted to the main frame at a predetermined position for engagement with the loop frame and to determine the initial position of the loop frame.

6. An apparatus as defined in claim 5 further comprising:

said stop means further including shock absorbing means.

7. An apparatus as defined in claim 1 wherein said brake means comprises:

a transversely extending plate mounted to the main frame at a location just below the path of travel of the web and located just forwardly of the last stationary roller in the first group of rollers, said plate being covered by a pad of material which is relatively resilient and has a relatively high coefficient of friction;

a transversely extending member mounted to the frame above the brake plate and above the path of travel of the web and being mounted for movement toward and away from the brake plate; and drive means operatively associated with the transverse brake member for moving the brake member toward or away from the brake plate.

8. A machine for temporarily interrupting a segment of a web of continuously moving material comprising:

a frame having a web receiving end and a web delivery end;

roller means defining a path of web travel through the machine, said roller means being constructed and arranged to define web loops of variable size at the web receiving and web delivery ends of the frame;

brake means mounted to the frame for gripping the web at a location between the web receiving and web delivery ends for stopping further advancement of a segment of the web;

said roller means including a pair of nip rollers mounted to the frame at the web receiving end thereof and in advance of the variable size loop at the web receiving end;

means responsive to a predetermined angular revolution of one of said nip rollers for operating the brake means and for beginning a new measurement of the angular rotation of said one of said nip rollers;

said means responsive to said predetermined nip roll revolutions comprising an optical shaft encoder having an input shaft directly connected to said nip roller; and means mounting the shaft encoder for limited movement in all directions except for rotation about the axis of the nip roll; and said loop forming means being constructed and arranged to enable delivery of a previously looped segment from the loop at the delivery end and to enable take up of web from the nip roller while said brake means is in gripping engagement with the web.

9. A machine for temporarily interrupting a segment of a web of continuously moving material comprising:

a frame having a web receiving end and a web delivery end;

roller means defining a path of web travel with respect to the frame, said roller means being constructed and arranged to define web loops of variable size at the web receiving ends and web delivery ends of the frame;

brake means mounted to the frame for gripping the web at a location between the web receiving and web delivery ends for stopping further advancement of a segment of the web;

said roller means including a pair of nip rollers mounted to the frame at the web receiving end thereof and in advance of the variable size loop at the web receiving end;

an optical shaft encoder having an input shaft directly connected to one of said nip rollers and being responsive to a predetermined angular revolution of said nip roller for operating the brake means and for beginning a new measurement of the angular rotation of said nip roller;

an elongate, flexible and resilient member mounted at one end to a portion of the frame, the other end extending away from that portion of the frame;

said shaft encoder including a housing;

means mounting the housing of the shaft encoder to the outwardly extending end of the flexible, resilient member, whereby said shaft encoder will be mounted for limited movement in all directions except for rotation about the axis of the nip roll; and said roller means being constructed and arranged to enable delivery of a previously looped segment from the loop at the delivery end and to enable take up of web from the nip roller while said brake means is in gripping engagement with the web.

10. A machine as defined in claim 9 wherein said flexible resilient member is substantially flat and lies in a plane which is substantially perpendicular to the axis of rotation of the nip roll.

11. An apparatus for temporarily interrupting the movement of a portion of an otherwise continually advancing web of material and for performing an operation on the temporarily interrupted portion of the web comprising:

a frame having a web receiving end and a web delivery end;

a first group of rollers mounted to the web receiving end of the frame;

a second group of rollers mounted to the delivery end of the frame;

at least one of the rollers in each of said groups thereof being mounted for movement toward and away from the other rollers in its associated group and being constructed and arranged to coperate with the other rollers in its associated group to form a looped path for the web;

said movable rollers each being mounted to opposite ends of a seesaw frame, pivotally mounted to the machine intermediate its ends to enable the movable rollers to be moved simultaneously and in opposite directions which will enlarge one of the loops and simultaneously shorten the other of the loops;

resetting means for urging the seesaw frame to a position in which the loop at the web receiving end is in its smallest configuration and the loop at the web delivery end is in its largest configuration;

brake means mounted to the frame for engagement with the web in proximity to the web receiving end of the frame and between the portion of the path of the web which is between the movable rollers for stopping a segment of the web which is disposed between the movable rollers;

control means responsive to advancement of a predetermined length of web through the machine for simultaneously operating the brake means and for releasing the looping frame to enable it to pivot freely in response to continued withdrawal of web material from the loop at the web delivery end;

said frame including means mounting a web operating instrumentality on the frame in a position to perform an operation on the portion of the web which has been interrupted;

control means for delaying operation of the web operating instrumentality until after operation of the brake means and release of the seesaw frame;

said control means further including means for deactivating the web operating instrumentality before deactivation of the brake and reactivation of the seesaw frame resetting means.

* * * * *